US005945157A

United States Patent [19]

Lee et al.

[11] Patent Number: 5,945,157

[45] Date of Patent: Aug. 31, 1999

[54] METHOD OF COATING GOLF CLUB HEAD UNDER VACUUM CONDITION WITH OPEN HANGER TYPE SHOT BLASTING MACHINE

[76] Inventors: Tsung Chi Lee, No. 23, Lane 13, Cheng Kung Road, Hou-Chang Village, Da-Liao Hsien, Kaohsiung Hsien; Tsai Yi Huang, No. 9, Lane 36, Tsao Yatelst Road, Ming-li Li, Chien Chen District, Kaohsiung, both of Taiwan

[21] Appl. No.: 08/909,700

[22] Filed: Aug. 12, 1997

[51] Int. Cl.[6] ..... B05D 3/02; B24C 5/00

[52] U.S. Cl. ..... 427/198; 427/309; 427/328; 427/374.1; 427/436; 72/47; 72/53; 473/324; 473/349

[58] Field of Search ..... 427/11, 327, 198, 427/309, 328, 374.1, 436; 473/345, 349, 324; 72/47, 53

[56] References Cited

U.S. PATENT DOCUMENTS

| | | | |
|---|---|---|---|
| 3,989,861 | 11/1976 | Rasmussen | 473/330 |
| 5,094,810 | 3/1992 | Shira | 419/31 |
| 5,131,986 | 7/1992 | Harada et al. | 473/345 |
| 5,154,425 | 10/1992 | Niskanen et al. | 473/342 |
| 5,228,615 | 7/1993 | Lijina et al. | 473/345 |
| 5,524,698 | 6/1996 | Chen et al. | 164/72 |
| 5,766,091 | 6/1998 | Humphrey et al. | 473/349 |

*Primary Examiner*—Shrive Beck
*Assistant Examiner*—Bret Chen
*Attorney, Agent, or Firm*—Rosenberg, Klein & Bilker

[57] ABSTRACT

A method of coating a golf club head under vacuum conditions with an open hanger type shot blasting machine includes the steps of forming a blank of golf club head; grinding the blank to form large pores on the surface of the blank; polishing the blank to form a refined blank containing fine pores on the surface thereof; hanging multiple refined blanks on hangers in an opening hanger type shot blasting machine to rotate and move the blanks into a vacuum rear portion of the machine. Meanwhile, shot blasting material containing mixed shot grit and powdered metal coating material is centrifugally thrown with mechanical throwing arms, so that shot grit strikes and forms numerous deeply depressed pores on the refined blanks. The shot grit quickly leaves the surfaces of the refined blanks due to a reactive force produced during impact of the shot grit on the blanks. The powdered metal coating material, due to a small reactive force at impact on the blanks and a diameter smaller than that of the depressed pores formed by the shot grit on the blanks, tends to deposit in the depressed pores and firmly adhere thereto. With a final hard anodizing treatment, the blanks become finished golf club heads having a hard protective metal coating.

1 Claim, 5 Drawing Sheets

METHOD OF COATING GOLF CLUB HEAD UNDER VACUUM CONDITION WITH OPEN HANGER TYPE SHOT BLASTING MACHINE

BACKGROUND OF THE INVENTION

Golf is presently a very popular sport which is helpful in a player's perseverance, patience and sharp attention. Golf is not only a good sport and amusement, but also a good way to establish good social relationships with others.

In a golf game which is usually held in the outdoors with widely spread grass, a golf club head often hits some hard rocks or stones exposed form beneath the grass. This, plus frequent impact of the golf club head with golf balls, makes the golf club head metal coating subject to be easily worn out, which adversely affects the beauty and use of the golf club.

In view of the fact that the golf club head is frequently used to strongly strike a golf ball, it is a common practice to coat the golf club head with suitable metal material, including sprayed and plated metal layers, to enhance and protect the beauty and hardness thereof. The plated metal layer is a protective film produced on a surface of the metal golf club head through an electrochemical reaction. In the electrochemical reaction, the metal golf club head is hung in an electrolyte and is connected to a negative electrode of a DC power source and the coating metal material is also hung in the electrolyte and is connected to a positive electrode of the DC power source. When a circuit between the two electrodes is made, the electrochemical reaction starts. The protective film so formed is very weak. As for a general sprayed coating, it can only form a protective film which penetrates into the protected metal to a limited depth. That is, the sprayed coating can only form a very thin film attached to a superficial area of the metal golf club head. Either the plated or the sprayed metal coating on the metal golf club head tends to easily peel off or become worn out when the golf club is frequently used to strike the golf ball.

It is therefore desirable to develop an effective method of coating a golf club head so a to eliminate the drawbacks from the protective layer being easily worn out or peeling off, as found in the conventional plating or spraying method for golf club heads.

BRIEF DESCRIPTION OF THE DRAWINGS

The steps, features, and benefits of the method according to the present invention can be best understood by referring to the following detailed description of the preferred embodiment and the accompanying drawings, wherein.

DETAILED DESCRIPTION OF THE PREFERRED EMBODIMENT

Figure 1:
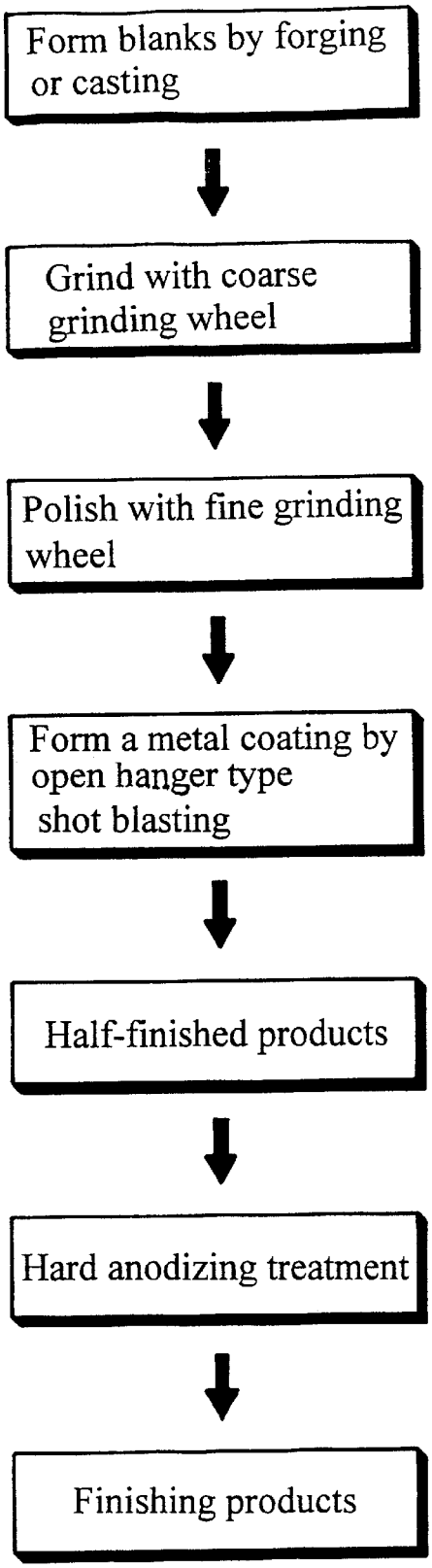
FIG. 1 is a flow chart of the method according to the present invention.
Figure 2:
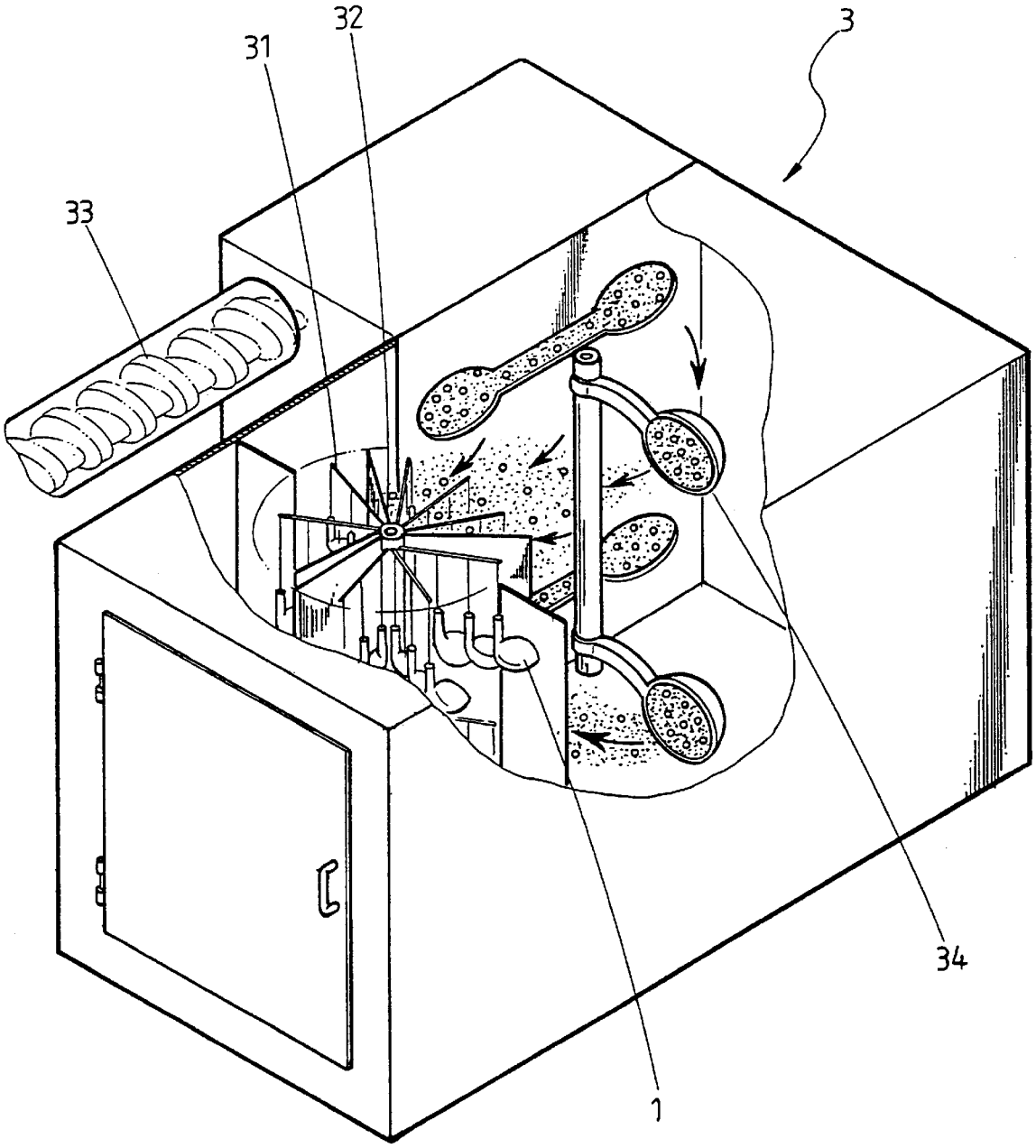
FIG. 2 is a perspective view showing the apparatus with which the method of the present invention is carried out.
Figure 3:
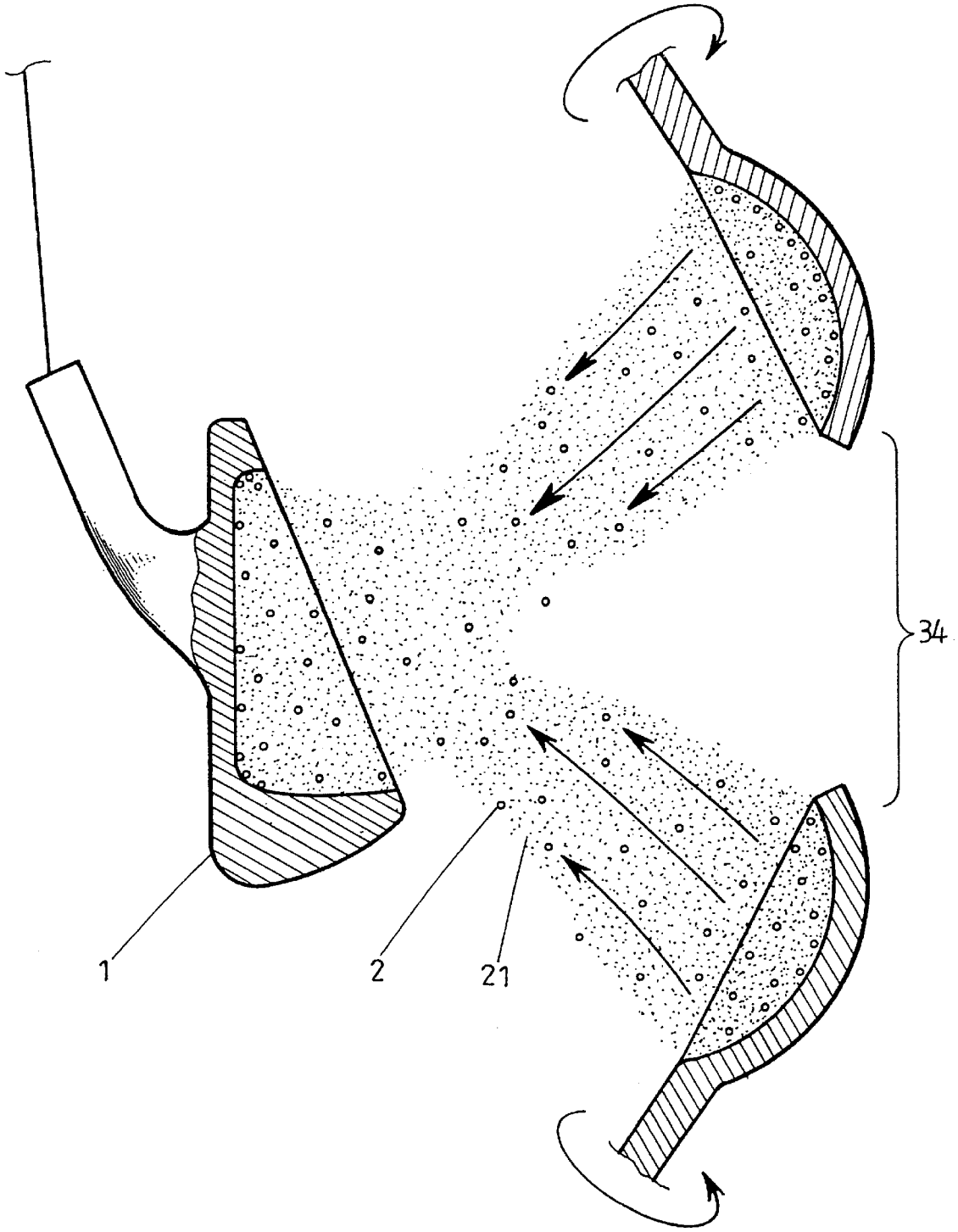
FIG. 3 shows a golf club head being coated with protective metal material through shot blasting by the method of the present invention.
Figures 4A, 4B, 4C:
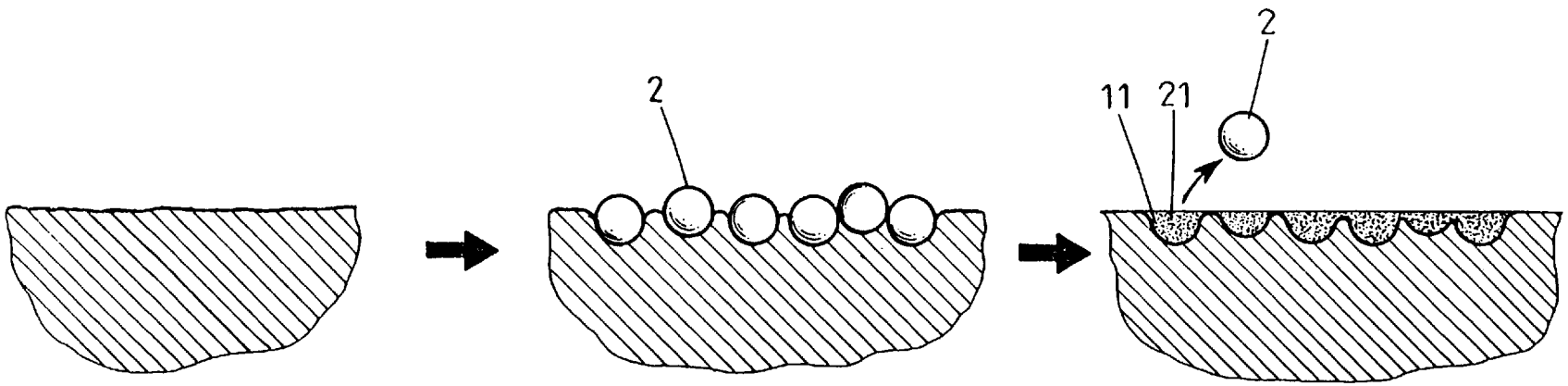
FIG. 4*a* represents a portion of a refined blank of the golf club head before shot blasting.
FIGS. 4*b* and 4*c* show the refined blank of FIG. 4*a* after shot blasting by the method of the present invention.

The present invention relates to a method of coating a golf club head under vacuum conditions with an open hanger type shot blasting machine. FIG. 1 is a flow chart showing the main steps included in this method. These steps include:

1. Forming a blank of golf club head 1 by forging or casting. Please refer to FIGS. 5*a* and 5*b* for an illustration of the shape of the golf club head 1.
2. Grinding the blank with a grinder using a coarse grinding wheel, so as to form large pores on a surface of the blank.
3. Polishing the blank with a grinder using a fine grinding wheel, so as to form a refined blank with fine pores on the surface of the blank.
4. Cleaning the refined blank with ultrasonic waves to remove grease and dirt from the surface thereof and to facilitate the adhesion and penetration of the coating material into the fine pores of the refined blank in subsequent steps.
5. As shown in FIG. 2, multiple refined blanks are hung on hangers 31 that are radially extending from a central shaft 32 of an open hanger type shot blasting machine 3. Since the shot blasting machine 3 is not an element of the present invention, it is not being described in detail herein.
6. Mixing the coating material, which is usually powdered metal is powdered titanium 21 in this case, with particulates of shot 2 having a diameter form about 0.2 mm to about 0.1 mm, to form a shot blasting material.
7. Guiding the shot blasting material, formed from mixing the shot grit 2 and the powdered titanium 21, to be coated on the refined blanks 1 in the open hanger type shot blasting machine 3 via a helical conveyer 33 connected to the shot blasting machine 3. The shot blasting material is fed into mechanical throwing arms 34 arranged in an evacuated rear portion p of the shot blasting machine 3. The vacuum of the rear portion p reduces possible air resistance to the impact during shot blasting and minimizes possible contamination of the refined blanks 1 by dust contained in the air.
8. Rotating the shaft 32 of the shot blasting machine 3, so that the refined blanks 1 hung on the hangers 31 are brought into the evacuated rear portion p of the machine 3. At this point, the shot blasting material mixed from the shot grit 2 and the powdered titanium 21 and carried by the mechanical throwing arms 34 are thrown out and toward the refined blanks 1 under a centrifugal force. The particulate shot grit 2 in the shot blasting material can be recovered for reuse. The shot grit 2 can be replenished when the particulates of the shot grit 2 are worn out to have only a very small diameter.
9. Keeping centrifugally throwing the shot blasting material against the refined blanks 1, as shown in FIG. 3, so that hard particulates of the shot grit 2 strike the refined blanks 1 and form numerous deeply depressed pores 11 on the surface of the refined blanks 1. Since the shot grit 2 has a larger diameter than the powdered titanium 21, their impact on the refined blanks 1 produces a larger reaction and therefore causes the shot grit 2 to soon fall from the depressed pores 11 on the surfaces of the refined blanks 1, as depicted in FIGS. 4*a*, 4*b* and 4*c*. On the other hand, a small mass and a small reaction from the impact of the powdered titanium 21 on the refined blanks 1 causes delayed falling of the powdered titanium 21 from the surface of the refined blanks 1. Moreover, the impact of the shot grit 2 on the refined blanks 1 produces high temperature which in turn generates static, allowing the powdered titanium 21 to more easily deposit in the deeply depressed pores 11 and firmly adhere thereto. At this point, a plurality of half-finished products of golf club heads having a titanium coating are formed.

Figure 5A:
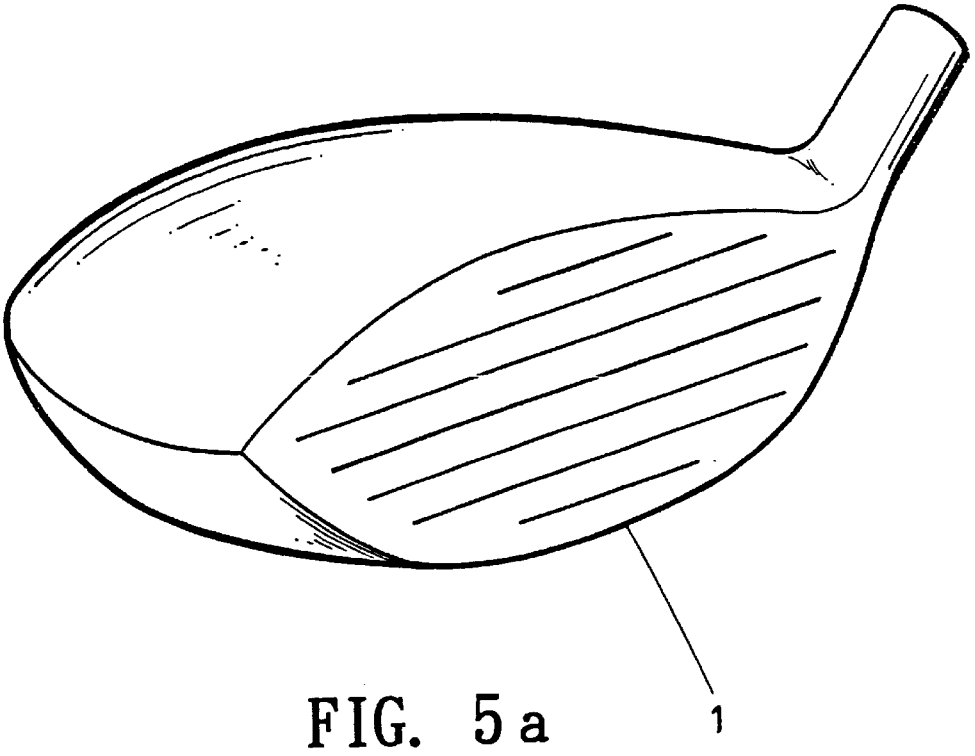
FIGS. 5*a* and 5*b* are perspective views showing finished golf club heads having a protective metal coating formed by the method of the present invention.
Figure 5B:
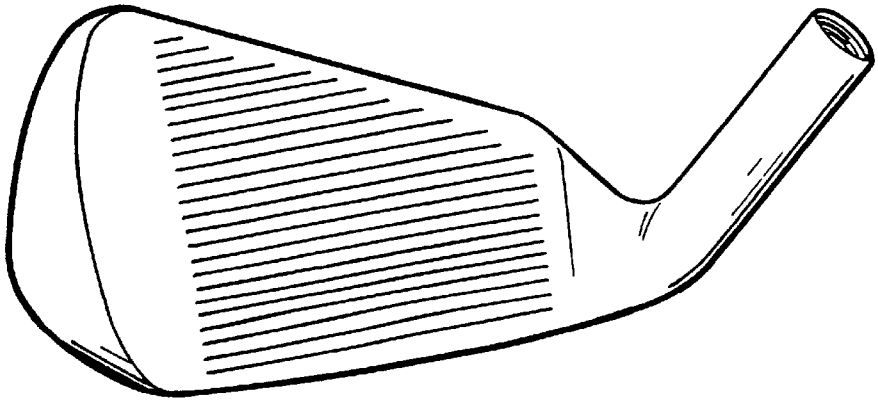

10. Heating the half-finished golf club heads 1 to a high temperature and immersing them in an electrolyte. The electrolyte may have different compositions and mixing ratios depending on the coating material. The heated half-finished products immersed in the electrolyte are then instantly frozen to a temperature of −8° C. (that is, the so-called hard anodizing treatment), so that a hard and tough metal coating about 0.1 mm to 0.2 mm in thickness is formed on the surface of these half-finished products. FIGS. 5*a* and 5*b* illustrate finished golf club heads made from the above steps.

Following are the advantages and the effects of the method of the present invention:

1. In the method of the present invention, shot blasting material containing shot grit 2 and a coating material of powdered titanium 21 is centrifugally thrown to hit and spread over the refined blanks of the golf club heads 1, so that the shot grit 2 impacts on the refined blanks to form numerous deeply depressed pores 11 on the surfaces of the refined blanks. These pores 11 increase the surface area of the blanks to allow the powdered titanium 21 to more easily adhere to the depressed pores 11. Moreover, the impact of the shot grit 2 on the refined blanks generates high temperature and static which further facilitates firm adhesion of the powdered titanium 21 to the surfaces of the golf club heads 1, more than the conventional spraying and plating methods do.
2. The finished product after the hard anodizing treatment according to the present invention has a metal coating which increased the golf club head's hardness by 7 to 8 degrees HRC (Rockwell Hardness, C specification).
3. The method of the present invention allows the powdered metal, particularly powdered titanium 21, to be coated on the golf club head 1 in the form of powder. The metal coating so formed has, therefore, very high purity. The metal coating material need not be attached to the golf club head 1 through a chemical reaction, via electrolysis.
4. The shot blasting material, including the shot grit 2 and the coating material of powdered titanium 21, being centrifugally thrown toward the refined blank of golf club head 1 can be evenly distributed all over the golf club head to fill all curved and bent corner portions and pores on the refined blank that cannot be reached during grinding and polishing.

What is to be noted is the form of the present invention shown and disclosed herein, which is to be taken as a preferred embodiment of the invention and that various changes in the shape, size, and arrangements of parts may be resorted to without departing from the spirit of the invention or the scope of the subjoined claims.

What is claimed is:

1. A method of coating a golf club head under a vacuum condition with an open hanger shot blasting machine for creating a metal coating firmly adhering to a surface of the golf club head to beautify and protect the golf club head, comprising the following steps:

a. forming a blank of the golf club head by forging or casting;

b. grinding the blank with a grinder using a coarse grinding wheel so as to form large pores on a surface of the blank;

c. polishing the blank with a grinder using a fine grinding wheel so as to form a refined blank with fine pores on the surface thereof;

d. cleaning the refined blank with ultrasonic waves to remove grease and dirt from the surface thereof;

e. hanging multiple refined blanks obtained from the above steps on hangers radially extending from a central shaft of an open hanger type shot blasting machine;

f. preparing a shot blasting material by mixing powdered metal to be used as a coating material with particulates of a shot blasting medium having a diameter from about 0.1 mm to about 0.2 mm;

g. guiding the shot blasting material mixed from the shot and the powdered metal coating material into the open hanger shot blasting machine via a helical conveyer connected to the shot blasting machine, and feeding the shot blasting material into mechanical throwing arms arranged in an evacuated rear portion of the shot blasting machine so as to reduce air resistance to impact during shot blasting and minimize contamination of the refined blanks by dust contained in air external to the shot blasting machine;

h. rotating the central shaft and accordingly the hangers of the shot blasting machine to move the refined blanks hung on the hangers into the evacuated rear portion of the shot blasting machine, so that the shot blasting material mixed from the shot and the powdered metal coating material and carried by the mechanical throwing arms is centrifugally thrown toward the refined blanks;

i. continuing centrifugally throwing the shot blasting material against the refined blanks so that the shot strikes the refined blanks to form numerous depressions on surfaces of the refined blanks and produces heat and static electricity; the shot having a larger diameter than the powdered metal coating material and therefore leaves a respective surface of the refined blanks sooner due to a higher reactive force produced when the shot impacts on the refined blanks; and, the powdered metal coating material being affected by a smaller reactive force from its impact on the refined blanks as well as by the heat and static electricity produced during the impact of the shot on the refined blanks, the powdered metal coating material deposits in the depressions formed by the shot and firmly adheres thereto, forming a metal coating on the surfaces of the refined blanks which are now half-finished golf club heads; and j. heating the half-finished golf club heads and then immersing them in an electrolyte, followed by instantly freezing the half-finished golf club heads at a temperature of −8° C. by an anodizing treatment to finally form a finished product with a metal coating thereon.

* * * * *